US005248069A

United States Patent [19]

Consaga et al.

[11] Patent Number: 5,248,069

[45] Date of Patent: Sep. 28, 1993

[54] VISCOUS FLUID PRESSURIZING APPARATUS

[75] Inventors: Ronald J. Consaga, Poughquag; Richard A. Heath, Pleasant Valley; Charles W. Hunter, Jr., New Windsor; Donald Reid, Livingston, all of N.Y.; Rodney E. Turk, Acworth, Ga.

[73] Assignee: International Business Machines Corporation, Armonk, N.Y.

[21] Appl. No.: 890,897

[22] Filed: May 29, 1992

[51] Int. Cl.[5] ..... B67D 5/00

[52] U.S. Cl. ..... 222/386; 222/389; 277/168

[58] Field of Search ..... 222/386, 389, 262, 256; 277/168-172; 220/93

[56] References Cited

U.S. PATENT DOCUMENTS

| | | | |
|---|---|---|---|
| 203,194 | 4/1978 | Rhoades . | |
| 1,716,485 | 10/1924 | Davis . | |
| 2,309,446 | 1/1943 | Ekkebus | 222/386 X |
| 2,388,391 | 11/1945 | Czerner | 222/256 |
| 2,504,683 | 4/1950 | Harnley . | |
| 3,057,521 | 10/1962 | Ballard | 222/262 |
| 3,327,904 | 6/1967 | Goda et al. | 222/386 X |
| 3,768,705 | 10/1973 | Spatz | 222/386 X |
| 3,786,966 | 1/1974 | Behunin et al. | 222/389 X |
| 3,843,026 | 10/1974 | Giovannozzi | 222/389 |
| 3,918,355 | 11/1975 | Weber | 222/386 X |
| 4,632,281 | 12/1986 | Wold | 222/389 |
| 4,819,836 | 4/1989 | Meckenstock | 222/386 |
| 4,951,848 | 8/1990 | Keller | 222/386 |
| 5,037,009 | 8/1991 | Shea | 222/386 |

*Primary Examiner*—Kevin P. Shaver
*Attorney, Agent, or Firm*—Richard Lau

[57] ABSTRACT

Apparatus for pressurizing a paste for dispensing the paste includes a vessel, a follower plate and a resilient seal which is movable through the vessel with the follower plate. The resiliency of the seal provides pressure for developing a seal between the seal and the vessel, and pressurized paste provides additional pressure for developing the seal.

14 Claims, 5 Drawing Sheets

VISCOUS FLUID PRESSURIZING APPARATUS

TECHNICAL FIELD

The present invention relates generally to viscous fluid pressurizing apparatus and, more particularly, to such an apparatus capable of applying high pressures on highly viscous paste.

BACKGROUND OF THE INVENTION

Many industries utilize highly viscous paste which must be highly pressurized for filtering and packaging of the paste. Such industries include the electronics, pharmaceutical and chemical industries. For instance, specifically, in the electronics industry, thick film conductive paste is used in multi-layer ceramic packaging of semiconductor devices. Typically, such paste can have a viscosity in the range of 25,000 to 75,000 centipoise (CPS) or greater, and a pressure in the range of 300 to 1,500 pounds per square inch (PSI) or greater may be required to properly move the paste through, for example, a wire mesh filter with 40 micron openings.

Previous paste pressurizing apparatus utilized a high pressure pneumatic extrusion pump fed by a low pressure pneumatic ram follower plate system. However, such pressurizing apparatus generally resulted in unpredictable and imprecise paste pressures which reduced filter life and made pressure measurements difficult and impractical. Moreover, the follower plate system generally introduced air into the high pressure extrusion pump, causing the undesirable result of air being incorporated into the paste product. These extrusion pump systems also tended to add frictional impact to the product due to the required pumping action. Frictional impact causes particle deformation and leads to the undesirable result of metallic platelet formation in the product, thus reducing product quality.

Another disadvantage associated with extrusion pump systems is that considerable amounts of residual paste remain in the system after processing is complete. This is due to the overall design of extrusion pump systems which does not allow for complete discharge of product from the system. Incomplete paste discharge is wasteful in terms of cost and efficiency. Further, since extrusion pump systems incorporate many components assembled in a complicated manner, residual paste is a particularly significant problem when the same pump system is required to pump more than one type of paste, and the different paste types cannot be intermixed. In this regard, it is extremely difficult and time-consuming to disassemble the pump system for cleaning residual paste from the various components before pumping another paste type.

Generally speaking, U.S. Pat. No. 4,819,836 to Meckenstock discloses a dispenser for paste compositions. However, the Meckenstock dispenser is manufactured by injection molding and is thus designed only for the dispensing of relatively low viscosity paste compositions, such as toothpaste. The Meckenstock dispenser design cannot be employed in high pressure applications for moving high viscosity pastes. Furthermore, the problem of introduction of air into the product persists in the Meckenstock dispenser.

U.S. Pat. No. 4,951,848 to Keller discloses a viscous material dispenser with a vented delivery piston for avoiding the inclusion of air in the storage cylinder above the viscous material contained in the dispensing cartridge. The piston has a vent hole passing therethrough which seats a closing screw. However, the closing screw must be manually tightened for closing the vent hole after all air is released. Thus, the air release mechanism of the Keller dispenser is inefficient and tedious. Moreover, the overall design of the Keller dispenser is incapable of pressurizing highly viscous fluid to high pressures.

Thus, there remains a need for a viscous fluid pressurizing apparatus which is capable of exerting high pressure on highly viscous fluid, which substantially discharges the entire amount of product contained in the apparatus, which is easily assembled and disassembled, and which automatically and conveniently releases air before pressurizing so that air will not be included in the product as a result of the pressurizing apparatus.

SUMMARY OF THE INVENTION

It is therefore an object of the present invention to provide a new and improved viscous fluid pressurizing apparatus.

Another object of the invention is to provide a viscous fluid pressurizing apparatus capable of exerting high pressure on highly viscous fluid.

Yet a further object of the present invention is to provide a viscous fluid pressurizing apparatus which includes a mechanism for automatically and conveniently releasing air during pressurizing so that air will not be included in the product.

In order to accomplish the above and other objects of the present invention, an apparatus for pressurizing a paste for dispensing the paste, comprises a vessel with an inner wall, a bottom opening and a top opening. A follower plate is movable through the vessel. A resilient seal has a center, and is movable with the follower plate. The seal has a slanted lip therearound, and the tapered lip has a tapered bottom portion therearound which forms a sealing edge. The tapered bottom portion slants inwardly relative to the center of the seal for centering the seal within the vessel as the follower plate and seal are moved into the vessel. The slanted lip slants outwardly relative to the center of the seal so that the sealing edge has a diameter greater than the diameter of the inner wall; and the sealing edge is in contact with the inner wall when pressurizing paste. Thus, the slanted lip flexes inwardly toward the center of the seal such that resiliency of the seal provides pressure for sealing the sealing edge against the inner wall. Further, the slanted lip is exposed to pressurized paste in the vessel so that pressurized paste bears thereagainst so that the pressurized paste provides additional pressure for sealing the sealing edge against the inner wall. The pressurizing apparatus also includes means for moving the follower plate with the seal through the vessel for pressurizing paste contained in the vessel for discharging the paste through the bottom opening of the vessel.

BRIEF DESCRIPTION OF THE DRAWINGS

These and other objects, features, aspects and advantages will be more readily apparent and better understood from the following detailed description of the invention, in which.

DETAILED DESCRIPTION OF THE PREFERRED EMBODIMENTS

Figure 1:
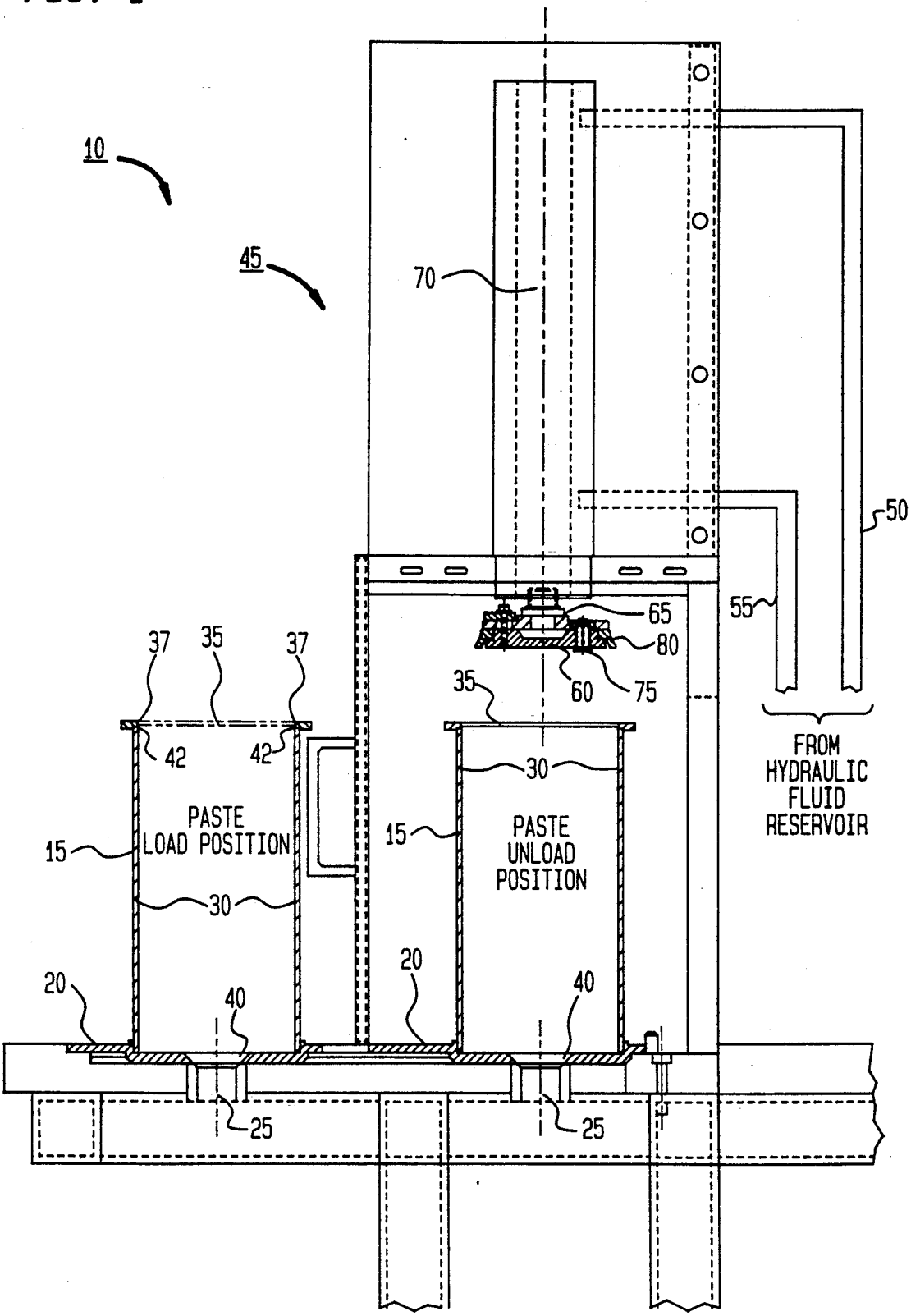
FIG. 1 shows a cross-sectional view of a pressurizing apparatus in accordance with the present invention.

Referring initially to FIG. 1, a fluid or paste pressurizing apparatus 10 in accordance with the present invention is shown. The pressurizing apparatus 10 includes a vessel 15 which may be, for example, cylindrical in shape. The vessel 15 is mounted to a mounting plate 20 which may be a component of a filtering and/or packaging system, or other similar system which requires paste pressurizing. The plate 20 includes an opening 25 which allows pressurized paste from the vessel 15 to flow therethrough for further processing, i.e., filtering and/or packaging. As shown, for convenience of paste loading, the mounting plate 20 with vessel mounted thereto is movable from a load position to an unload position.

Since the mounting plate 20, as well as the overall filtering and/or packaging system, are not the subject of the present invention, no further detail is believed necessary.

Figure 3B:
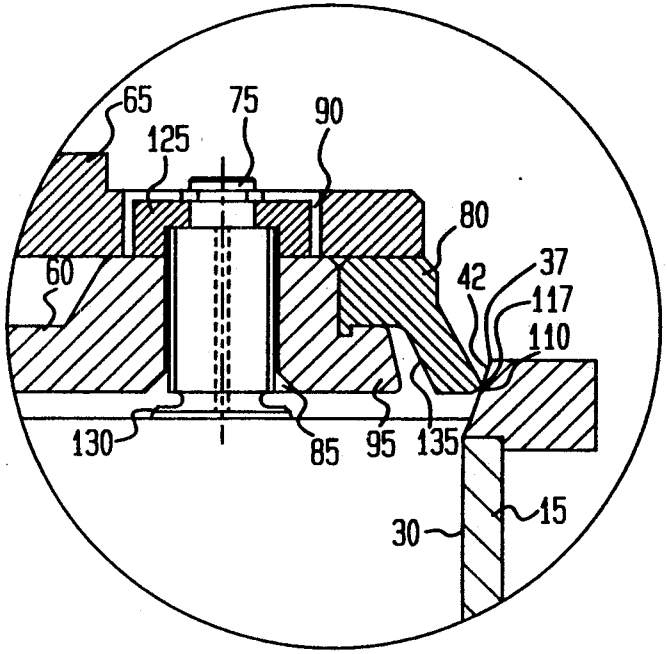
FIGS. 3A-B illustrate initial engagement of a wiper seal with a vessel in accordance with the present invention.
Figure 4B:
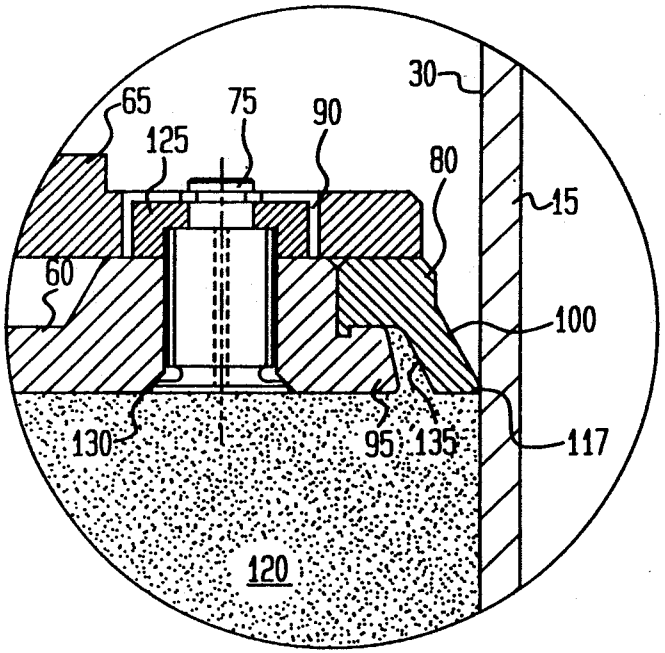
FIGS. 4A-B illustrate pressurizing of paste contained in a vessel in accordance with the invention.

As shown more particularly in FIGS. 3B and 4B, the vessel 15 includes an inner wall 30, a bottom opening 40, and a top opening 35 with a top edge 37. The vessel 15 and, for that matter, all components of the pressurizing apparatus, should comprise material capable of withstanding the high pressures referred to in the BACKGROUND OF THE INVENTION. In this regard, the vessel 15 can comprise stainless steel, carbon steel, ceramic, or other similar material. The bottom opening 40 of the vessel 15 allows for the discharge of pressurized paste from the vessel 15. Further, for reasons stated hereinafter, the top portion of the vessel 15 preferably includes a chamfer 42 therearound which is beveled so as to slant or taper outwardly toward the top edge 37 so as to form the top opening 35.

A ram 45 is positioned so as to be substantially directly above the vessel 15 when the vessel 15 is in the unload position. Those skilled in the art will appreciate that the ram 45 may be any conventional ram which is capable of delivering the required pressures for the types of pastes involved. For example, as shown, a hydraulic ram can be employed, in which case, hydraulic fluid lines 50, 55 from a reservoir (not shown) are required to be connected to the ram 45.

The ram 45 includes a follower plate 60 which is driven into the vessel 15 for contacting and pressurizing paste contained in the vessel 15. The follower plate 60 can comprise, for example, stainless steel, or other material capable of withstanding high pressures. A piston mounting plate 65 is mounted to the follower plate 60, and a piston 70 is mounted to the piston mounting plate 65. Attachment of the piston mounting plate 65 to the follower plate 60 can be accomplished by any conventional fastening means, such as using screws, nuts and bolts, threaded engagement of the components, etc. Further, the piston 70 can also be mounted to the piston mounting plate 65 by any conventional means, such as using retaining rings, lock nuts, etc.

As shown more particularly in FIGS. 3B and 4B, the follower plate 60 and the piston mounting plate 65 have corresponding apertures 85, 90, respectively, extending therethrough. A normally open, automatically closing air valve 75 is seated in the apertures 85, 90. Furthermore, a wiper seal 80 is fitted around the follower plate 60, and is sandwiched between a lip 95 of the follower plate 60 and the piston mounting plate 65. The air valve 75 allows air caught between the ram 45 and the paste to be relieved. Specific operation of the air valve 75 will be explained in more detail hereinafter.

Figure 2A:
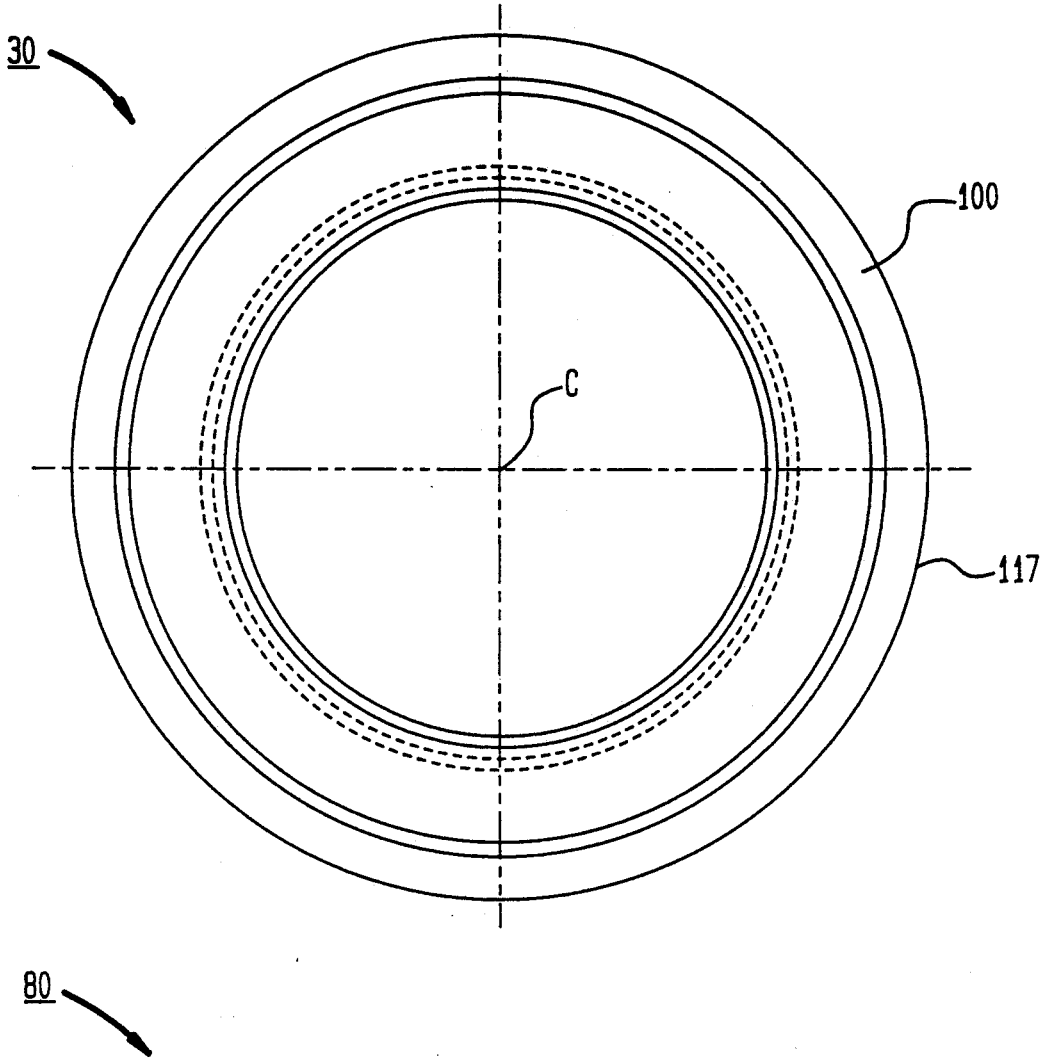
FIGS. 2A–B show a top view and a cross-sectional side view, respectively, of a wiper seal in accordance with the present invention.
Figure 2B:
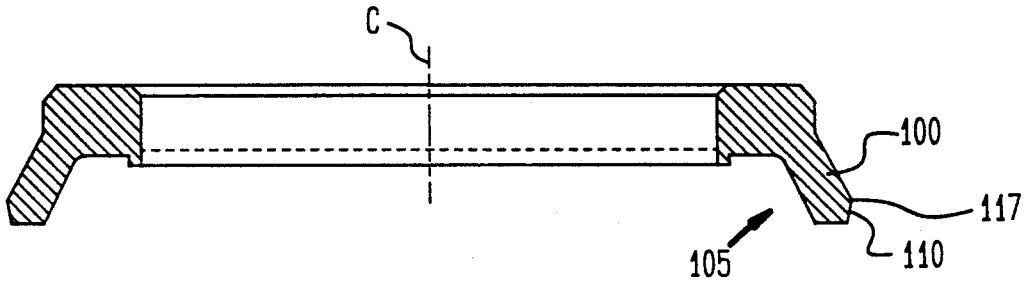

The wiper seal 80 is shown more particularly in FIGS. 2A-B. The shape of the wiper seal 80 should substantially correspond to the shape of the inner wall 30 of the vessel 15. Thus, if the vessel 15 is cylindrical then, as shown in FIG. 2A, the wiper seal 80 should be ring-shaped. The wiper seal 80 has a slanted lip or section 100 therearound, and the slanted section 100 has a bottom portion 105 which includes a first taper 110 therearound. The slanted section 100 slants outwardly relative to the center C of the wiper seal 80, and the first taper 110 of the bottom portion 105 slants inwardly relative to the center C of the wiper seal 80. The importance of the slanted section 100 and the first taper 110 will be explained in further detail hereinbelow.

A sealing edge 117 is formed by an edge of the first taper 110 of the slanted section 100. The diameter of the sealing edge 117 is the greatest diameter of the wiper seal 80. In other words, the sealing edge 117 is the edge of the wiper seal 80 which is outermost relative to its center C. Further, preferably, the diameter of the sealing edge 117 is greater than the diameter of the inner wall 30 of the vessel 15 but less than the diameter of the top edge 37 of the top opening 35 of the vessel 15. The greatest diameter of the first taper 110 of the slanted section 100 should also be less than the diameter of the top edge 37.

The wiper seal 80 should be constructed of a material capable of withstanding the high pressures required to be generated in this type of pressurizing apparatus. Moreover, the material used for the wiper seal 80 should be substantially rigid with minimal flexibility, and should also be resilient, i.e., resistant to deformation. For example, ultra-high molecular weight (UHMW) polyethylene has been found to be suitable for constructing the wiper seal 80. Other suitable material include Teflon and Delrin, both of which are trademarks for products manufactured by E.I. DuPont Nemours, Co., of Wilmington, Del.

Figure 3A:
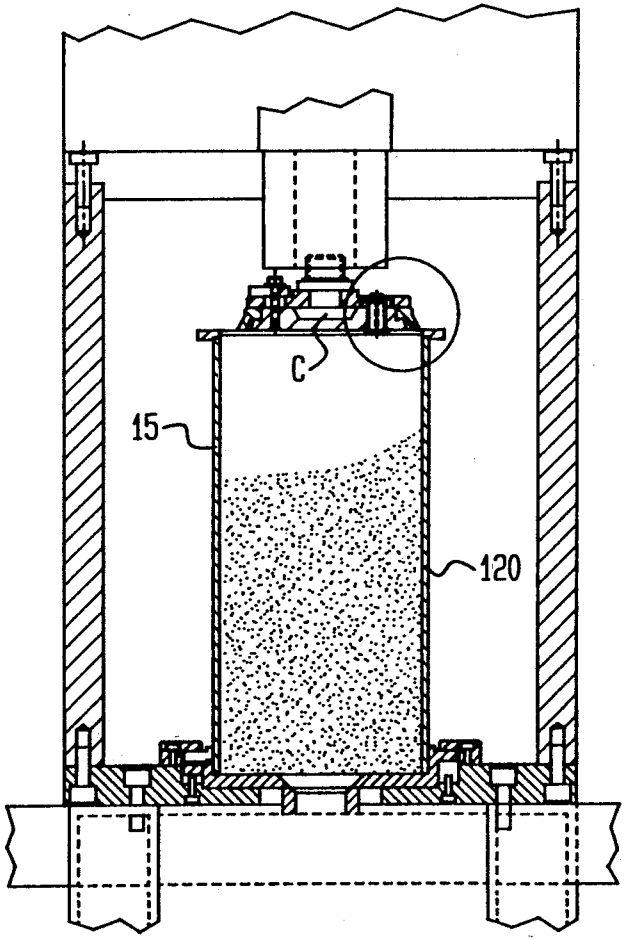
Figure 4A:
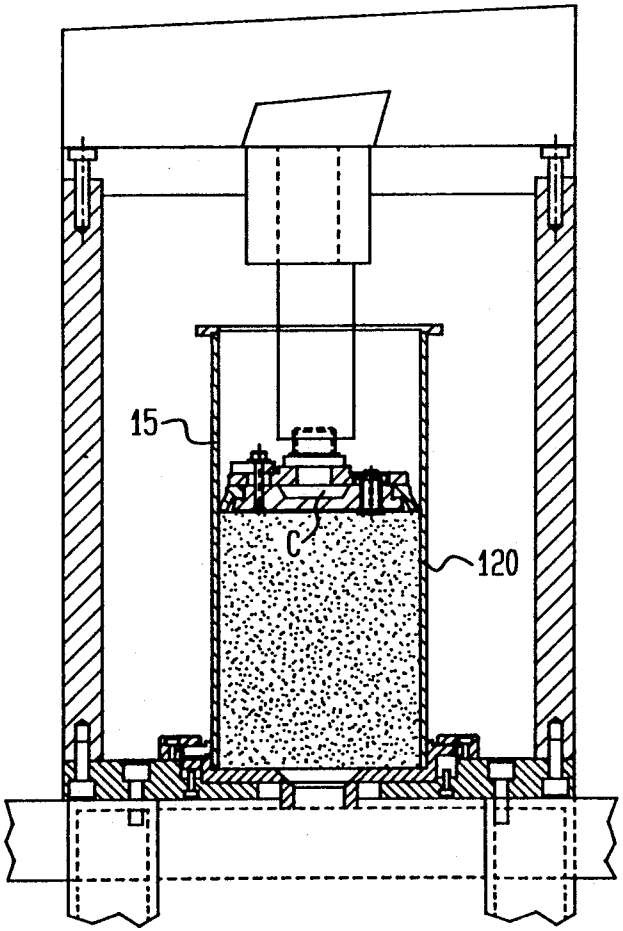

FIGS. 3A-B show initial engagement of the follower plate 60 and wiper seal 80 with the vessel 15, but before contacting paste 120 loaded in the vessel 15, and FIGS. 4A-B illustrate pressurizing of the paste 120.

Figure 5:
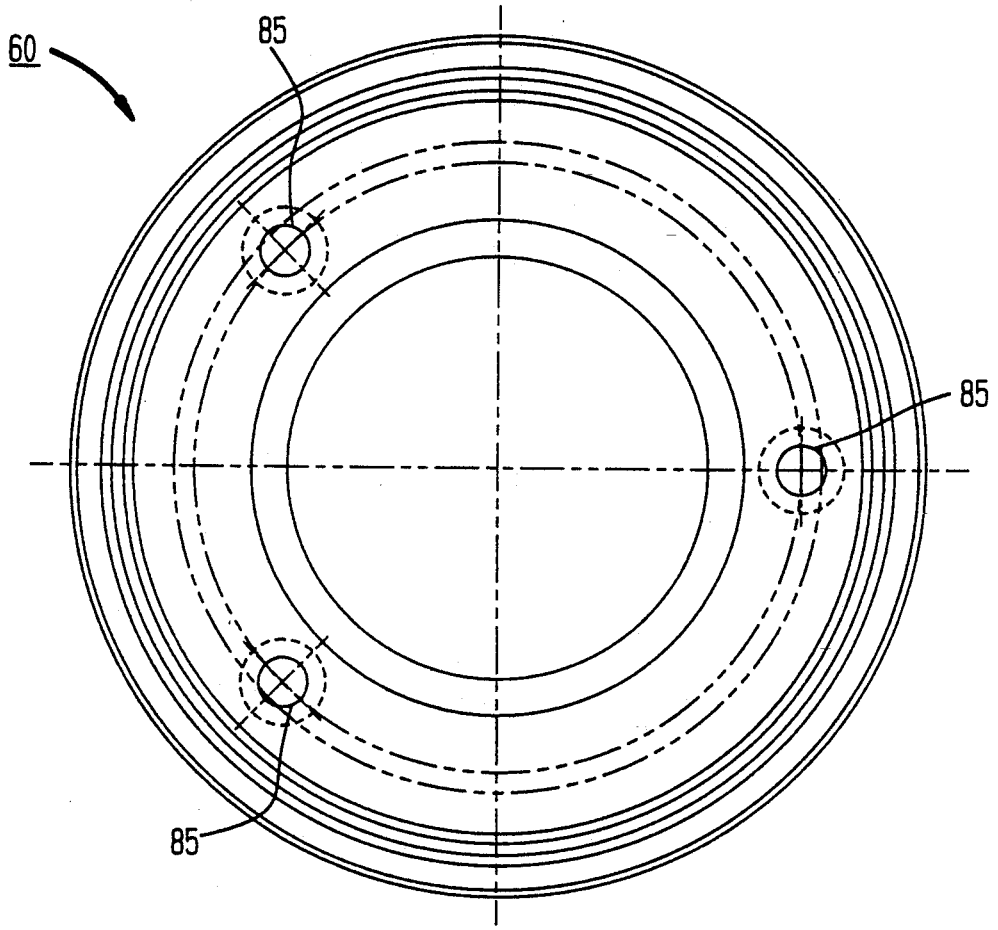
FIG. 5 is a top view of a follower plate in accordance with the invention.

As shown in FIG. 3A, due to the high viscosity of the paste 120, the paste 120 within the vessel 15 may have varying levels, i.e., the level of the paste 120 within the vessel 15 may be non-uniform so that the top surface of the paste 120 within the vessel 15 is uneven. As the ram 45 is driven into the vessel 15 to pressurize the paste 120, this unevenness will cause the ram 45 to initially contact the paste 120 at the higher levels. Because the normally open air valve 75 automatically closes when it contacts the paste 120, if the paste 120 at the higher levels first contacts the air valve 75, then the air valve 75 will close prematurely and the air caught between the ram 45 and paste 120 at the lower levels will not be relieved. Therefore, it is desirable to include more than one air valve 75 in the ram 45. In this regard, FIG. 5 shows a top view of a preferred embodiment of the follower plate 60 in which there are three apertures 85 equally spaced apart for reducing the likelihood that uneven paste will cause air to be caught between the ram 45 and the paste. Since identical air valves are to be utilized in each of the apertures 85, operation of only one air valve 75 will be discussed in greater detail, and will be representative of each of these air valves.

Before contacting the paste 120, due to the force of gravity, the air valve retainer 125 is situated on the follower plate 60, and the seal 130 of the air valve 75 is not seated on the tapered aperture 85 of the follower plate 60. In this position, the air valve 75 is in a normally open state so that air is allowed to pass around the air valve 75 and through the apertures 85 and 90.

As the piston 70 is set in motion for pressurizing the paste 120, initial contact will generally be made between the first taper 110 of the wiper seal 80 and the chamfer 42 of the vessel 15. As the follower plate 60 and wiper seal 80 are urged or moved further into the vessel 15, the first taper 110 of the wiper seal 80 becomes completely seated on the chamfer 42 causing the wiper seal 80 to be substantially aligned or "centered" within the chamfer 42, i.e., the wiper seal 80 will be disposed within the chamfer 42 such that the central vertical axis of the wiper seal 80 will substantially coincide with the central longitudinal axis of the vessel 15.

Further urging of the follower plate 60 and wiper seal 80 into the vessel 15 results in inward flexing of the slanted section 100 of the wiper seal 80 toward the center C of the wiper seal 80 until the first taper 110 no longer makes contact with the chamfer 42. In this regard, the slanted section 100 of the wiper seal 80 allows for the inward flexing. As shown in FIGS. 3A-B, the sealing edge 117 will then make contact with the chamfer 42.

As the follower plate 60 and wiper seal 80 are further urged into the vessel 15, the sealing edge 117 continues to contact the chamfer 42, and the slanting of the chamfer 42 causes further inward flexing of the slanted section 100 toward the center C. Eventually, the sealing edge 117 is urged past the chamfer 42, and into contact with the inner wall 30 of the vessel 15. Thus, the slanted section 100 of the wiper seal 80 is flexed inwardly toward the center C until the sealing edge 117 contacts the inner wall 30 so that the sealing edge 117 will have a diameter which is equal to the diameter of the inner wall 30 of the vessel 15. Further, the wiper seal 80 is maintained inwardly flexed by the inner wall 30.

Because of the rigidity of the material required for construction of the wiper seal 80, and because the sealing edge 117 has an original diameter which is greater than the diameter of the inner wall 30 of the vessel 15, the resiliency of the wiper seal 80 causes the inwardly flexed slanted section 100 to attempt to return to its normal, unflexed state. Thus, pressure is exerted by the slanted section 100 against the inner wall 30 so that a seal is formed between the sealing edge 117 and the inner wall 30.

The air valve 75 solves the problem of air being incorporated with the paste as the paste is being pressurized. In this regard, the air valve 75 allows any air caught between the follower plate 60 and the paste 120 to escape so as to relieve air entrapment developed therebetween as the follower plate 60 is urged further into the vessel 15. As shown in FIGS. 3A-B, since the open air valve 75 is lower than the follower plate 60, i.e., the open air valve 75 is closer to the paste 120 than the follower plate 60, initial contact with the paste 120 is made by the air valve 75. After this initial contact, as the follower plate 60 is urged closer to the paste 120, the air valve 75 will begin to close, and air between the follower plate 60 and paste 120 will continue to be released through the air valve 75. As the follower plate 60 contacts the paste 120, the lower seal 130 of the air valve 75 will seat into the tapered aperture 85 of the follower plate 60 so as to develop an air tight seal. At this point substantially all air caught between the follower plate 60 and paste 120 will have been relieved. Thus, the air valve 75 is in a normally open position and automatically closes as it contacts the paste.

Subsequent downward urging of the follower plate 60 pressurizes the paste 120. As the paste 120 is pressurized, the paste 120 bears against the inner surface 135 of the tapered section 100 of the wiper seal 80 so as to provide additional pressure for enhancing the seal between the sealing edge 117 and the inner wall 30 of the vessel 15. Furthermore, advantageously, further pressurizing of the paste 120 results in further enhancing of this seal. In other words, increasing pressure of the paste 120 by further downward urging of the follower plate 60, provides for increased pressure on the inner surface 135, resulting in more pressure being provided to the sealing edge 117, and thus more positive sealing of the sealing edge 117 against the inner wall 30. As such, the wiper seal 80 prevents paste 120 from escaping around the follower plate 60 as the paste 120 is being pressurized. When the paste 120 is sufficiently pressurized, it moves or discharges through the bottom opening 40 of the vessel 15, and through the opening 25 of the plate 20 for further processing.

In a preferred embodiment, in order to apply 1,200 PSI of pressure so as to move paste having a viscosity of 50,000 CPS, assuming that the vessel has an inner wall diameter of 4.875 inches, and the wiper seal comprises UHMW polyethylene, the following dimensions were found adequate:

angle of vessel chamfer = 15°
diameter of top edge of vessel = 5.034"
diameter of sealing edge of wiper seal = 4.950"
angle of first taper of wiper seal = 30°

It should be understood that the diameters of the top edge of the vessel and the sealing edge of the wiper seal depend on the diameters of the vessel and follower plate. In this connection, the diameter of the follower plate depends upon the diameter of the vessel, and the diameter of the vessel should be chosen so that a reasonable amount of pressure need be applied by the ram in order to adequately pressurize the paste. In other words, as the diameter of the vessel is decreased, less ram pressure is required for adequately pressurizing the paste. Therefore, the diameter of the vessel should be chosen so that an excessive amount of ram pressure is unnecessary for achieving adequate paste pressure.

Advantageously, the apparatus of the present invention is designed to allow for ease of disassembly for cleaning or repairing purposes. There are few components as compared to conventional apparatus designed for such pressures, and the components can be easily disassembled since they are conventionally assembled using screws, nuts and bolts, locking nuts, etc. In this regard, the apparatus of the present invention can be readily and quickly disassembled and cleaned for reducing intermixing of pastes when changing from pressurizing one paste type to another.

Further, unlike prior art extrusion pump systems, the apparatus of the present invention has no product being pumped and incorporates matched geometries of components, which allows for substantially complete discharge of product from the vessel. Advantageously, substantially complete discharge minimizes or eliminates product cross-contamination in continuous batch processing and product waste in individual batch processing mode.

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

What is claimed is:

1. An apparatus for pressurizing a paste for dispensing the paste, comprising:

a vessel comprising an inner wall, a bottom opening and a top opening;

a follower plate being movable through said vessel;

a resilient seal having a center, and being movable with said follower plate, said seal having a slanted lip therearound, and said slanted lip having a tapered bottom portion therearound which forms a sealing edge, said tapered bottom portion slanting inwardly relative to the center of said seal for aligning said seal within said vessel as said follower plate and seal are moved into said vessel, and said slanted lip slanting outwardly relative to the center of said seal so that said sealing edge has a diameter greater than the diameter of said inner wall, said sealing edge being in contact with said inner wall when pressurizing paste such that said slanted lip flexes inwardly toward the center of said seal such that resiliency of said seal provides pressure for sealing said sealing edge against said inner wall, and said slanted lip being exposed to pressurized paste in said vessel so that pressurized paste bears thereagainst so that the pressurized paste provides additional pressure for sealing said sealing edge against said inner wall; and means for moving said follower plate with said seal through said vessel for pressurizing paste in said vessel for discharging the paste through said bottom opening of said vessel.

2. An apparatus according to claim 1, further comprising at least one valve means extending through and being movable with said follower plate, said at least one valve means being in a normally open state and being automatically activated to a closed state upon contact with paste, such that air between said follower plate and the paste is released and said at least one valve closed before pressurizing of the paste.

3. An apparatus according to claim 2, wherein said at least one valve means comprises a plurality of valves so as to allow for substantially complete relief of air from between said follower plate and paste when the level of paste with said vessel is uneven.

4. An apparatus according to claim 1, wherein said top opening of said vessel includes a chamfer which is beveled for inserting said seal into said vessel.

5. An apparatus according to claim 4, wherein said seal is centered within said vessel by seating of said tapered bottom portion on said chamfer.

6. An apparatus according to claim 4, wherein said chamfer includes a top edge having a diameter, and said sealing edge has a diameter which is less than the diameter of the top edge of said chamber.

7. An apparatus according to claim 1, wherein said means for moving said follower plate includes a piston.

8. An apparatus according to claim 7, wherein said piston includes hydraulic means for hydraulically driving said piston.

9. An apparatus according to claim 1, wherein said seal comprises ultra-high molecular weight polyethylene.

10. An apparatus according to claim 1, wherein said follower plate comprises stainless steel.

11. An apparatus according to claim 1, wherein said seal has a shape which substantially corresponds to the shape of said inner wall of said vessel.

12. An apparatus according to claim 1, wherein said vessel is cylindrical.

13. An apparatus according to claim 12, wherein said seal is ring-shaped.

14. An apparatus according to claim 1, wherein said vessel, follower plate and seal have matched geometries allowing for substantially complete discharge of paste from said vessel.

* * * * *